US005769904A

United States Patent [19]

Meerschman et al.

[11] Patent Number: 5,769,904

[45] Date of Patent: Jun. 23, 1998

[54] PROCESS FOR THE PRODUCTION OF RESISTS OR MULTICOLOR EFFECTS ON NATURAL AND SYNTHETIC POLYAMIDE FIBRE MATERIALS

[75] Inventors: Guy Achilles Alfons Meerschman, Waregem; Jean-Pierre Troch, Buggenhout; Serge Charles Jacques Garing, Rhode Saint Genése, all of Belgium

[73] Assignee: Ciba Specialty Chemicals Corporation, Tarrytown, N.Y.

[21] Appl. No.: 863,313

[22] Filed: May 27, 1997

[30] Foreign Application Priority Data

May 29, 1996 [CH] Switzerland ..... 1346/96

[51] Int. Cl.[6] ..... D06P 5/12

[52] U.S. Cl. ..... 8/455; 8/606; 8/924; 8/929

[58] Field of Search ..... 8/455, 606, 924, 8/929

[56] References Cited

U.S. PATENT DOCUMENTS

| | | | |
|---|---|---|---|
| 3,564,630 | 2/1971 | Moussalli | 8/606 X |
| 3,775,045 | 11/1973 | Buehler et al. | 8/448 |
| 3,869,250 | 3/1975 | Wegmuller et al. | 8/606 X |
| 4,285,691 | 8/1981 | Egli et al. | 8/455 |
| 4,411,665 | 10/1983 | Egli et al. | 8/455 |
| 4,859,207 | 8/1989 | Bouwknegt et al. | 8/455 |
| 5,443,598 | 8/1995 | Baumann | 8/455 |

FOREIGN PATENT DOCUMENTS

| | | |
|---|---|---|
| 1489456 | 10/1977 | United Kingdom . |
| 2102454 | 2/1985 | United Kingdom . |

OTHER PUBLICATIONS

Pospischil et al., Chemical Abstracts, 114:187510, 1991.
Baumann et al., Chemical Abstracts, 107:79413, 1987.
Beckmann et al, Melliand Textilberichte, (1973), pp. 641–646.
Bayer Farben Revue, No. 21, (1972), pp. 32–49.

*Primary Examiner*—Fiona T. Powers
*Attorney, Agent, or Firm*—David R. Crichton

[57] ABSTRACT

This invention relates to a process for the production of resists or multicolor effects on natural or synthetic polyamide fiber materials, which, to produce resists, comprises locally applying a liquid preparation wet-on-wet before or after treating the textile material with a dyeing liquor or printing paste containing at least one anionic dye, said preparation comprising one or more than one compound of formula (1)

wherein $R_1$ is a straight-chain or branched $C_{10}$–$C_{24}$alkyl or alkenyl radical, $R_2$ and $R_3$ are each independently of the other $C_1$–$C_4$alkyl, X is the radical of an anion, and the benzene nucleus A may be further substituted, or which, to produce multicolor effects, comprises locally applying one or more than one liquid preparation wet-on-wet before or after treating the textile material with a dyeing liquor or printing paste containing at least one anionic dye, said preparation comprising containing, in addition to one or more than one compound of formula (1), at least one anionic dye, and lastly subjecting the textile goods to a heat treatment to fix the dye. Excellent resists or multicolor effects are obtained by the process of this invention.

12 Claims, No Drawings

PROCESS FOR THE PRODUCTION OF RESISTS OR MULTICOLOR EFFECTS ON NATURAL AND SYNTHETIC POLYAMIDE FIBRE MATERIALS

The present invention relates to a process for dyeing natural and synthetic polyamide fibre materials with anionic dyes, producing resist or multicolour effects. Two-step processes for tone-in-tone resists or multicolour effects are known from the literature. In this case the resist can first be fixed and the fibre material can then be further dyed. In a wet-on-wet process, dyeing can be carried out e.g. in the presence of resists. Where compositions are used having good affinity for fibres, the resist (or multicolour effect) obtained is usually not satisfactory. In these latter processes, the choice of suitable dyes is restricted.

A process has now been found by which it is possible to achieve excellent resists or multicolour effects on natural and synthetic polyamide fibre material if the specific resisting agent used in wet-on-wet processes is one or several of the compounds described hereinafter.

Accordingly, this invention relates to a process for the production of resists or multicolour effects on natural or synthetic polyamide fibre materials, which, to produce resists, comprises locally applying a liquid preparation wet-on-wet before or after treating the textile material with a dyeing liquor or printing paste containing at least one anionic dye, said preparation comprising one or more than one compound of formula

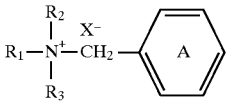

(1)

wherein $R_1$ is a straight-chain or branched $C_{10}$–$C_{24}$ alkyl or alkenyl radical, $R_2$ and $R_3$ are each independently of the other $C_1$–$C_4$alkyl, X is the radical of an anion, and the benzene nucleus A may be further substituted, or which, to produce multicolour effects, comprises locally applying one or more than one liquid preparation wet-on-wet before or after treating the textile material with a dyeing liquor or printing paste containing at least one anionic dye, said preparation comprising, in addition to one or more than one compound of formula (1), at least one anionic dye, and lastly subjecting the textile goods to a heat treatment to fix the dye.

A preferred process for the production of resists or multicolour effects comprises locally applying one or more than one liquid preparation after treating the textile material with a dyeing liquor or printing paste containing at least one anionic dye, and then subjecting the textile goods to a heat treatment to fix the dye.

Another preferred process for the production of resists or multicolour effects comprises locally applying one or more than one liquid preparation before treating the textile material with a dyeing liquor or printing paste containing at least one anionic dye, and then subjecting the textile material to a heat treatment to fix the dye.

In the compounds of formula (1), $R_1$ may be all straight-chain or branched alkyl and alkenyl radicals having 10 to 24 carbon atoms. Typical examples are: decyl, undecyl, dodecyl, tridecyl, tetradecyl, hexadecyl, heptadecyl, octadecyl and oleyl. $R_1$ is preferably a straight-chain alkyl or alkenyl radical. $R_1$ is particularly preferably a straight-chain alkyl radical having 14 to 18 carbon atoms.

$R_2$ and $R_3$ are each independently of the other suitably the following alkyl radicals: methyl, ethyl, n-propyl, isopropyl, n-butyl, sec-butyl, isobutyl and tert-butyl. $R_2$ and $R_3$ are preferably identical. $R_2$ and $R_3$ are particularly preferably methyl.

The benzene nucleus A can, for example, by further substituted by $C_1$–$C_4$alkyl, $C_1$–$C_4$alkoxy and halogen. The benzene nucleus A preferably has no further substituents.

The above compounds of formula (1) are used as salts of e.g. the hydrohalic acids or sulfuric acids, typically as chlorides and sulfates. X defined as anion is typically a halogen anion, such as —$Cl^-$, —$Br^-$, or a sulfate ion. X is preferably the chloride ion.

Interesting compounds of formula (1) conform e.g. to formulae

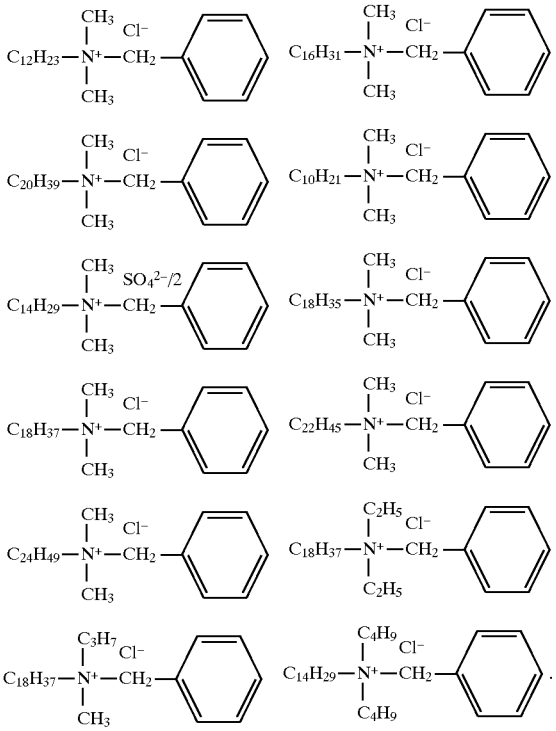

It is also possible to use mixtures of compounds of formula (1) in the process of this invention. Suitable mixtures are for example: The mixture of the compounds of formulae

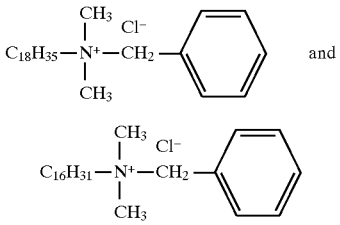

and in a ratio of 1:3 to 3:1, preferably of 2:1.

According to the process of this invention it is possible to use natural or synthetic polyamide fibre materials for resisting or for multicolour purposes. A suitable natural polyamide fibre material is preferably wool. Suitable synthetic polyamide fibre materials are typically polyamide 6 and polyamide 66 fibre materials. In the process of this invention, polyamide 6 and polyamide 66 carpet fibre materials are preferably used.

In the novel process it is possible to use anionic dyes. Suitable anionic dyes are, for example, those cited in the Colour Index, Third Edition, Volume 1, under Acid Dyes, pages 1001 to 1562 and also the corresponding dyes in the supplement volumes.

Suitable anionic dyes for the novel process are preferably those having a K value <5. Suitable dyes for dyeing (ground dyeing) the textile material and for producing the multi-colour effects are preferably those having a K value <5.

The K value is a measure known to the person skilled in the art of dyeing. This value is determined according to GB-PS 1 489 456, Bayer-Farbenrevue 21, 32 (1972) or Melliand 6, 641 (1973). This value is a measure of the dyeing behaviour of anionic dyes in conjunction with their combination capacity.

It is particularly preferred to use one or several of the following dyes in the novel process:

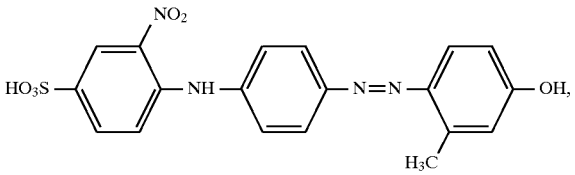

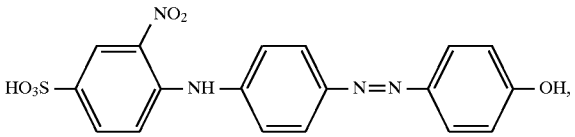

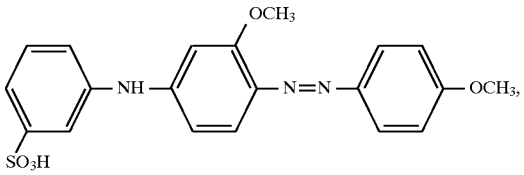

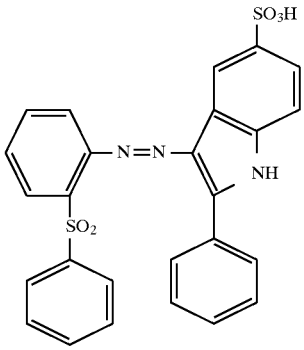

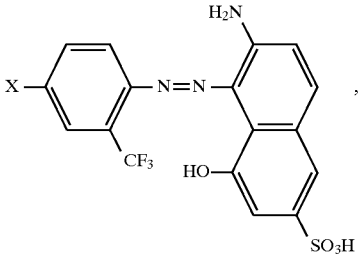

X = —Cl, —NHCOCH3

-continued

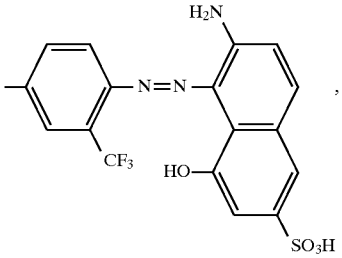

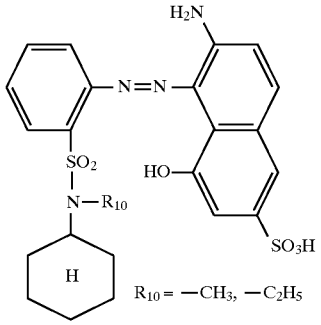

$R_{10}$ = —$CH_3$, —$C_2H_5$

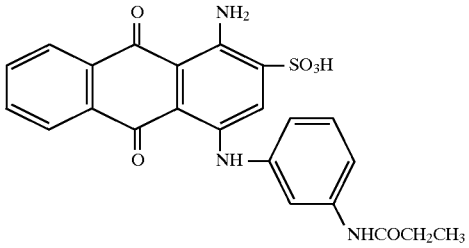

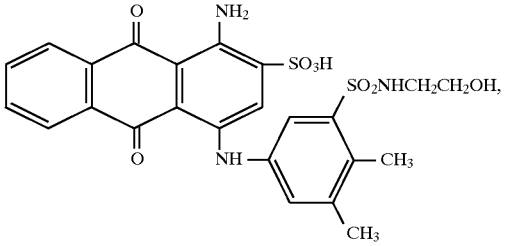

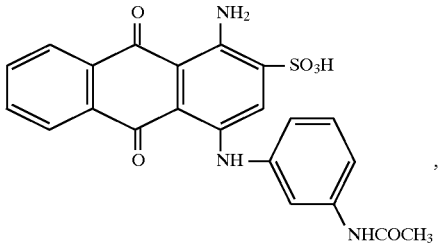

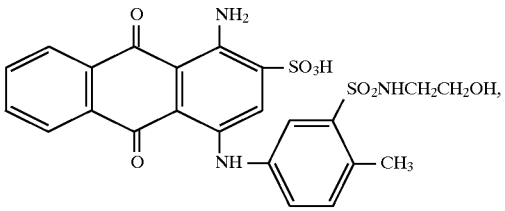

-continued
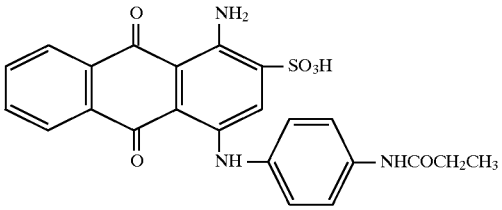
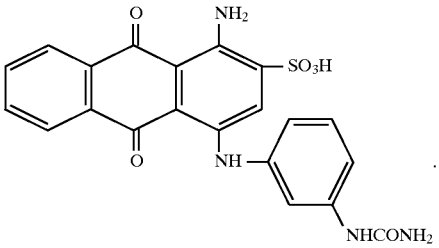
The red-dyeing dye used in the novel process is preferably at least one of the dyes of formulae
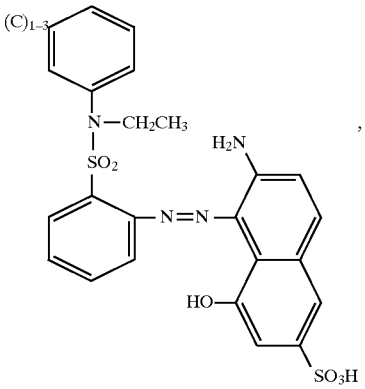
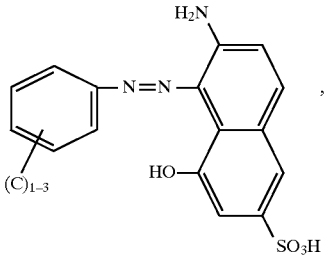
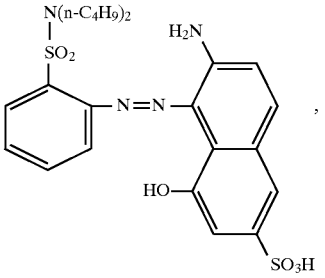
-continued
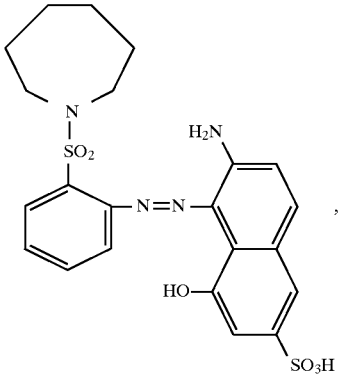
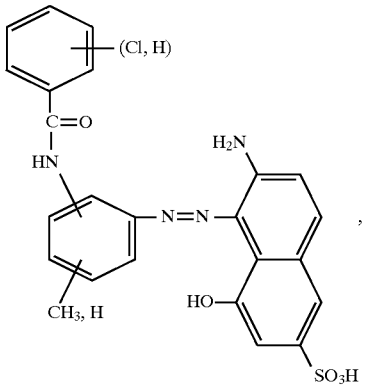
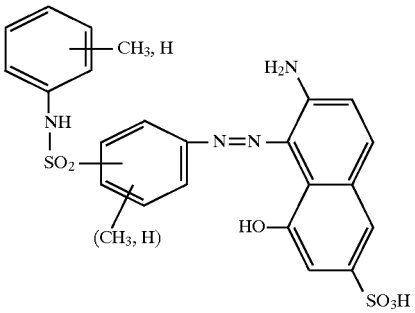
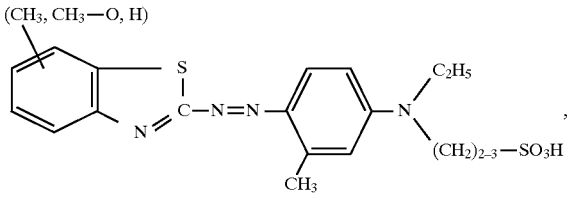
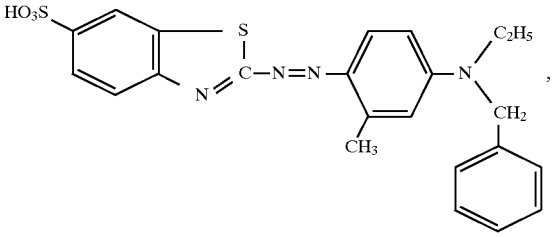

-continued
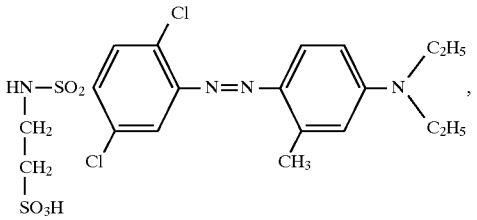
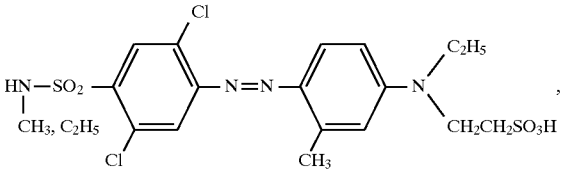
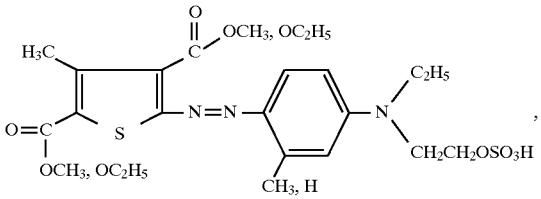
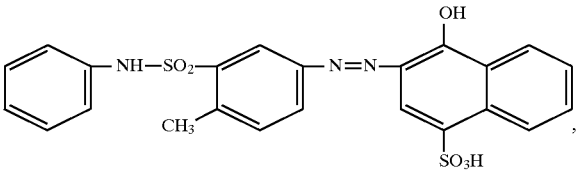
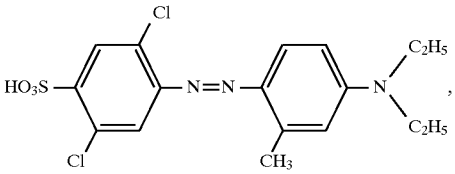
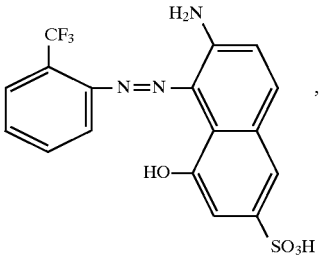
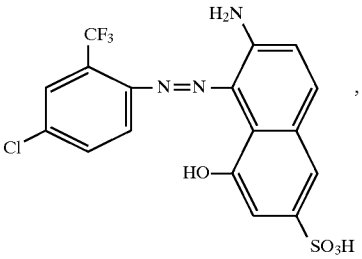
-continued
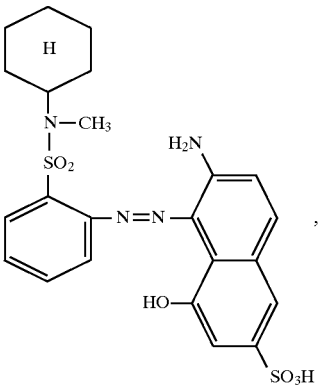
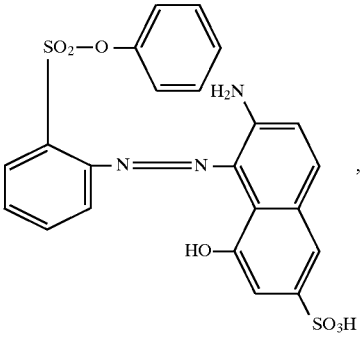
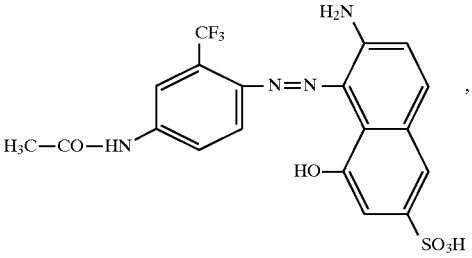
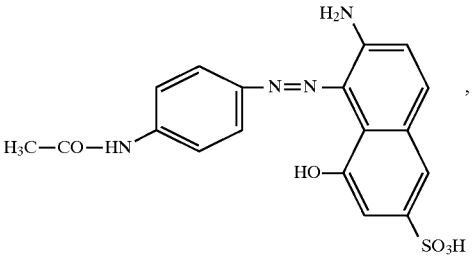
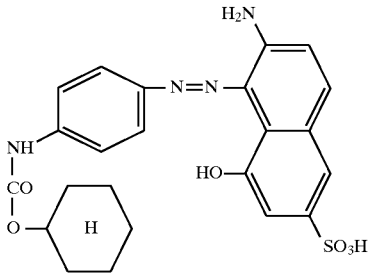

-continued

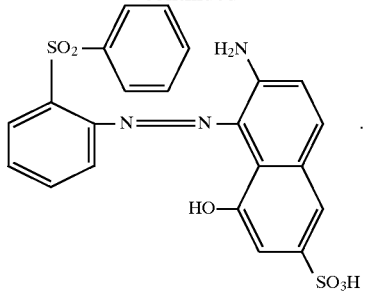

The yellow- or orange-dyeing dyes used in the novel process are preferably at least one of the dyes of formulae

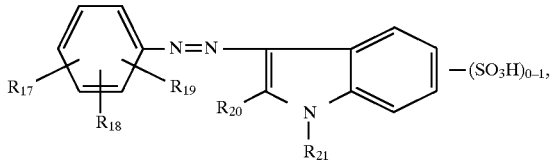

wherein $R_{17}$ is hydrogen, methyl, chloro, methoxy, ethoxy, o-methylphenoxy, phenoxy, acetylamino, phenylsulfonyl, p-methylphenylsulfonyl, p-chlorophenylsulfonyl, naphthylsulfonyl, p-methylbenzoyl or p-chlorobenzoyl, $R_1$ hydrogen, chloro, methyl, trifluormethyl, o-methylphenoxy, o-chlorophenoxy, o-chlorophenoxysulfonyl, $\chi SO_2NH_2$, N—$C_{1-2}$alkylaminosulfonyl, N,N-dimethylaminosulfonyl, N-β-sulfoethylaminosulfonyl, N-methyl-N-β-hydroxyethylaminosulfonyl, N-methyl-N-cyclohexylaminosulfonyl, N-phenylaminosulfonyl, N-o-methylphenylaminosulfonyl, N-o-chlorophenylaminosulfonyl, N-m-trifluoromethylphenylaminosulfonyl, N-ethyl-N-phenylaminosulfonyl, —$CONH_2$or —$CON(CH_3)_2$, $R_{19}$ is hydrogen or chloro, $R_{20}$ is methyl or phenyl, and $R_{21}$ is hydrogen, methyl, ethyl or octyl,

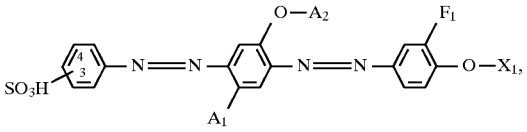

wherein $A_1$ is hydrogen or methyl, $F_1$ is hydrogen or methyl, and $A_2$ and $X_1$ are each independently of the other hydrogen, methyl, ethyl, β-hydroxyethyl, β-hydroxypropyl, β-hydroxybutyl or α-ethyl-β-hydroxyethyl, and the sulfo group is bound in 3- or 4-position,

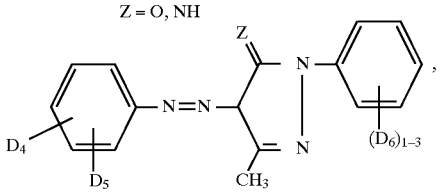

wherein $D_4$ is chloro or phenylaminosulfonyl, $D_5$ is hydrogen or sulfo, $(D_6)_{1-3}$ is 1 to 3 substituents $D_6$, and $D_6$ is hydrogen, chloro or sulfo, or

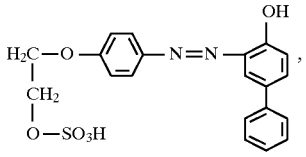

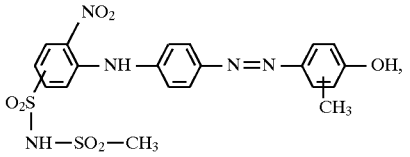

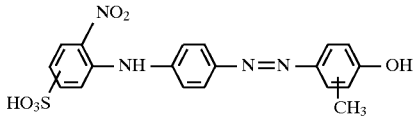

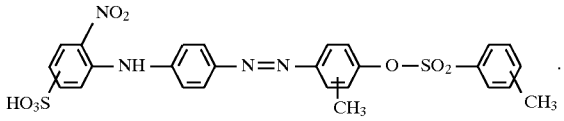

Suitable yellow- or orange-dyeing dyes are preferably e.g. the following dyes:

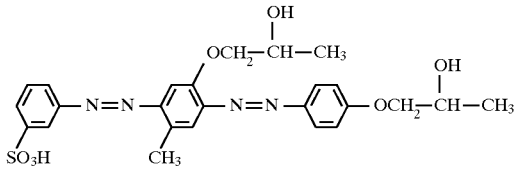

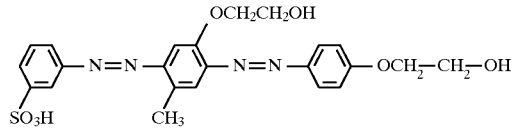

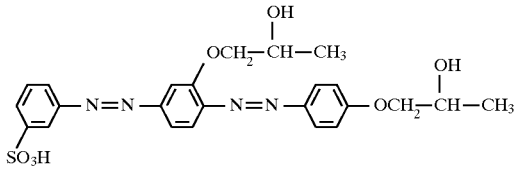

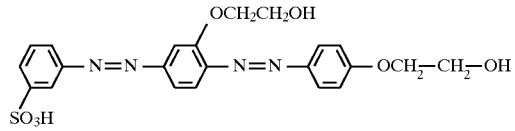

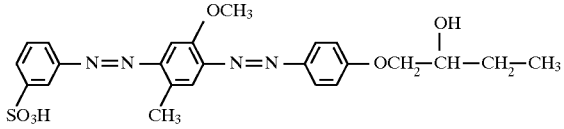

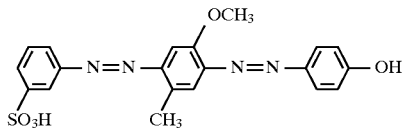

-continued
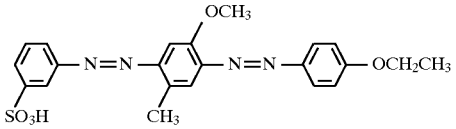
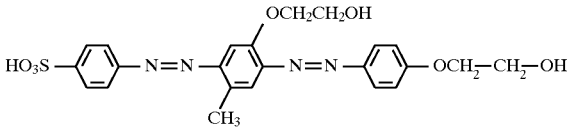
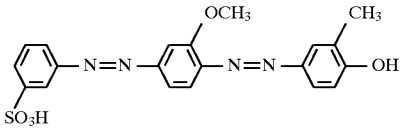
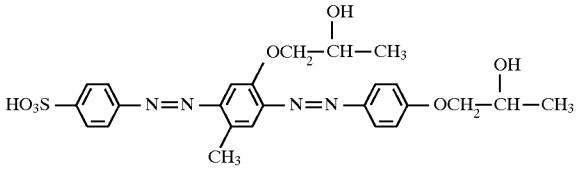
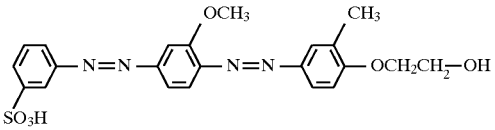
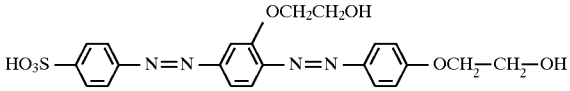
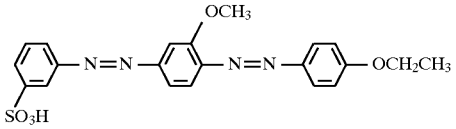
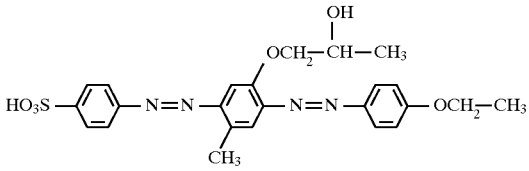
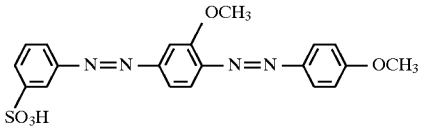
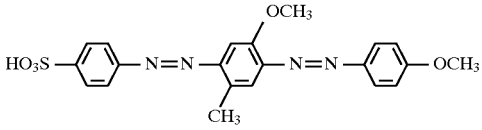
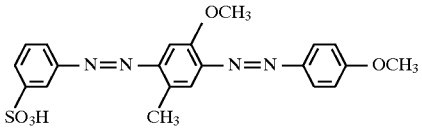
-continued
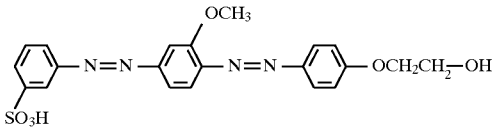
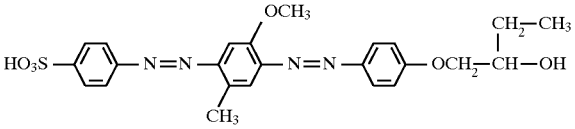
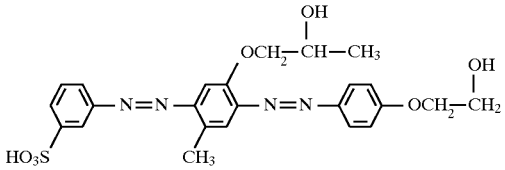
Suitable yellow- or orange-dyeing dyes are preferably e.g. the following dyes:
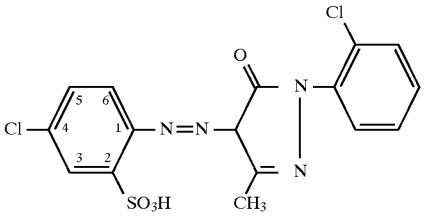
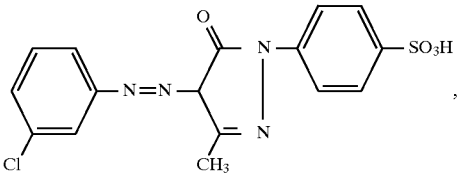
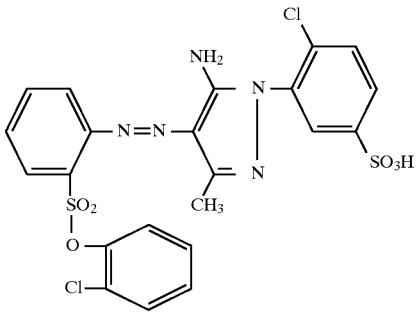
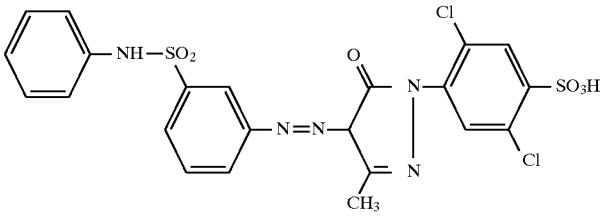

-continued

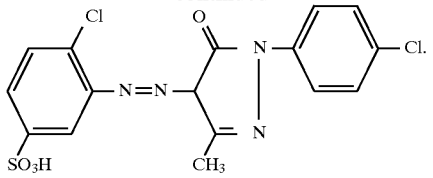

Also preferred is the yellow-dyeing dye of formula

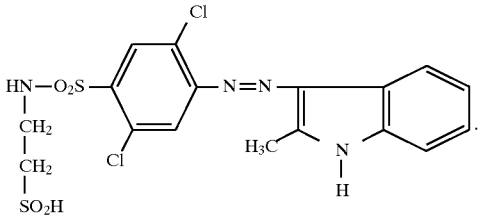

Likewise preferred yellow- or orange-dyeing dyes are those of formulae

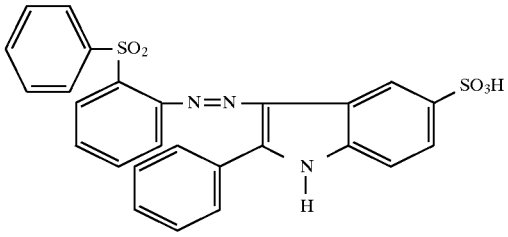

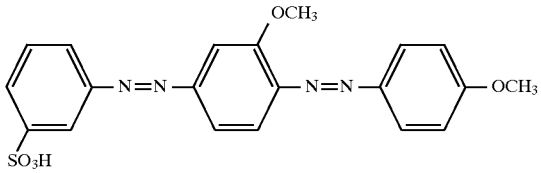

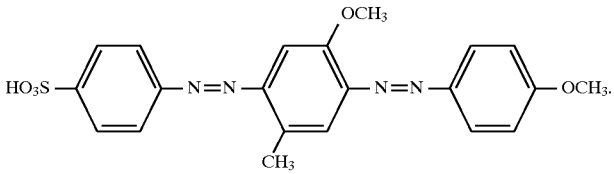

Preferred blue-dyeing dyes are suitably the following dyes:

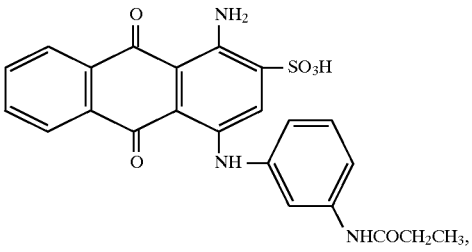

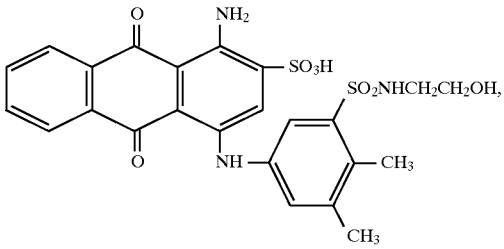

-continued

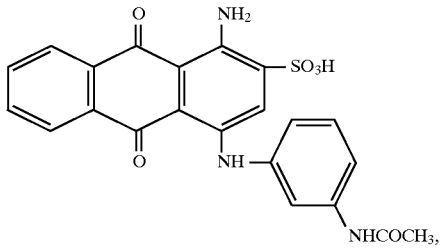

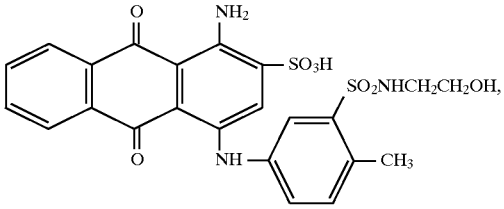

-continued

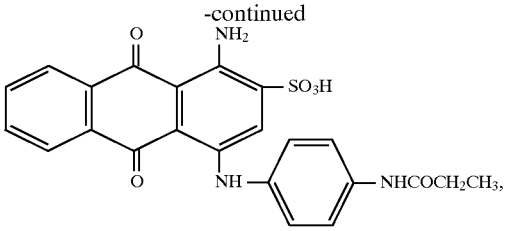

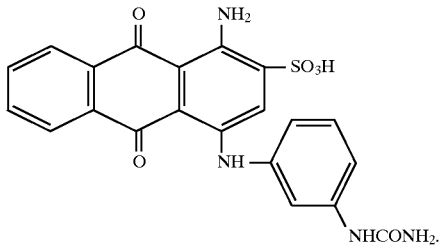

A preferred embodiment of the novel process is that wherein the first step of the process relates to ground dyeing by customary methods with an anionic dye, preferably with one or several of the above-mentioned dyes. This dyeing is carried out in known manner by padding, pouring, sloppadding and similar methods at room temperature. Preferred anionic dyes are those which contain one or more than one sulfo group, preferably one sulfo group. The anionic dyes suitable for use are known from the Colour Index (see above). Known assistants may additionally be used in the liquors, typically thickeners, wetting agents and dispersants. The pH of the liquor is adjusted to 4–7, preferably to 5–6. The liquor pick-up is in the range from about 60–200%, preferably from about 80–120% (based on the weight of the dry goods). Local treatment is carried out immediately afterwards, i.e. without any intermediary washing or drying, using a given or random pattern and a liquor or paste comprising one or more than one compound of formula (1). The compounds of formula (1) should have a certain affinity to the anionic dyes employed. This affinity can be determined by the following test: Two dye solutions are prepared a) 0.2 $cm^3$ of a 1% dye solution in 5 $cm^3$ of demineralised water b) a solution of a) with the addition of 0.5 ml of the aqueous 0.4% solution of the compound of formula (1). One drop each of solution a) and b) is deposited on a thin chromatographic layer at room temperature and dried. The spot of solution a) is coloured on the entire (diffuse) layer, whereas that of solution b) may only be coloured in the centre and must be almost colourless towards the edge. The compounds of formula (1) used according to this invention are dispersants of the cation-active type having levelling or retarding properties.

The local application of the second batch, comprising the compound of formula (1), is carried out using printing machines of the screen and/or rotary film printing, rotary relief printing or jet printing type. In accordance with this invention, it is also possible to use drop patterning processes and patterning processes used for yarns (known e.g. as space dyeing). The assistants to be used according to this invention in the second printing liquor or printing paste are used in amounts from about 0.1 to 5 g/l, preferably from 0.1 to 2 g/l, particularly preferably from 0.7 to 2 g/l, based on the liquor or paste. If bi- or multicolour effects are desired, the second batch comprises an anionic dye. This anionic dye preferably has a K value <5, which is also preferred in the first dyeing (for ground dyeing). It is also possible to apply several pastes or liquors simultaneously or one after the other. Preferred anionic dyes are acid or direct dyes, preferably acid dyes. All of these are known from the Colour Index. The second liquor can also contain additional conventional additives or assistants, typically thickeners. Depending on the nature of the substrate used, the pH of the liquor or paste is adjusted to 4 to 7 (e.g. with acids, such as acetic acid, or by adding weak alkalis (acting as buffers, e.g. $Na_3PO_4$ and $Na_2HPO_4$; the additives must be alkali-compatible). Fixation is effected in known manner using hot air or hot steam, preferably the latter, at 98°–105° C. over 2–20, preferably 5–10, minutes. Washing and drying is carried out in known and conventional manner. The novel dyeing process is a continuous process of the wet-on-wet type. The multicolour and resist effects are sharp and marked, even when relatively small amounts of the compounds of formula (1) are used in accordance with this invention. Owing to savings in energy and water, this is particularly advantageous in carpet dyeing. Furthermore, it is possible to achieve a resist effect.

Another preferred embodiment of this invention is that wherein the first step of the process relates to resisting using one or more than one compound of formula (1) and, optionally, producing bi- or multicolour effects in the presence of anionic dyes. The local application of the first batch, comprising the compound of formula (1), is typically carried out by applying a liquor or paste or by using e.g. printing machines of the screen and/or rotary film printing, rotary relief printing or jet printing (e.g. Chromojet or Millitron) type. It is also possible to use drop patterning processes and patterning processes used for yarns (known e.g. as space dyeing) in accordance with this invention. The assistants to be used according to this invention in the first printing liquor or printing paste are used in amounts from about 0.1 to 5 g/l, preferably from 0.1 to 2 g/l, particularly preferably from 0.7 to 2 g/l, based on the liquor or paste. If bi- or multicolour effects are desired, the first batch comprises one or more than one anionic dye. These anionic dyes preferably have a K value <5, which is also preferred in the second dyeing (for ground dyeing). It is also possible to use several pastes or liquors simultaneously or one after the other. Preferred anionic dyes are acid or direct dyes, preferably acid dyes. All of these are known from the Colour Index. This liquor can also contain additional conventional additives or assistants, typically thickeners. Depending on the nature of the substrate, the pH of the liquor or paste is adjusted to 4–7 (e.g. with acids, such as acetic acid, or with weak alkalis (acting as buffers, e.g. $Na_3PO_4$ and $Na_2HPO_4$; the additives must be alkali-compatible).

In a second process step, the textile material is impregnated in a manner known per se direct, without any intermediary rinsing, washing and/or drying, with an acid dye liquor comprising at least one anionic dye. Subsequently, the textile material is subjected to a heat treatment to fix the dyes. Fixation is effected in known manner using hot air or hot steam, preferably the latter, at 98°–105° C. over 2–20, preferably 5–10, minutes. Washing and drying are carried out in known and conventional manner.

The novel process also has the advantage of achieving a shade of resist in the shade of the dyeing or printing.

The novel process can be used on textile fibres dyeable with anionic dyes and consisting of polyamides, e.g. of natural origin, such as wool or silk, but preferably on synthetic polyamide fibres such as polyamide 6 or 66. The finished textile materials can be wovens, knit-goods or also tufted carpets as well as yarns and cables. In the following Examples, parts are by weight or by volume, percentages are by weight, and temperatures are given in ° C.

EXAMPLE 1

A looped carpet consisting of polyamide 6 carpet yarn is partially printed with a printing paste comprising the following components (per 1000 parts): 0.5 part of the blue-dyeing dye mixture comprising 80% by weight of the dye which, in the form of the free acid, corresponds to formula

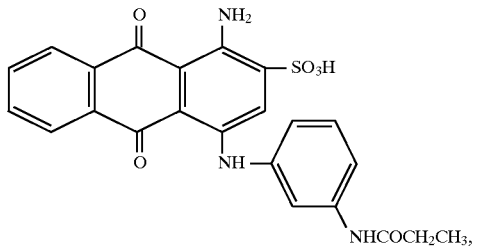

and 20% by weight of the dye which, in the form of the free acid, corresponds to formula

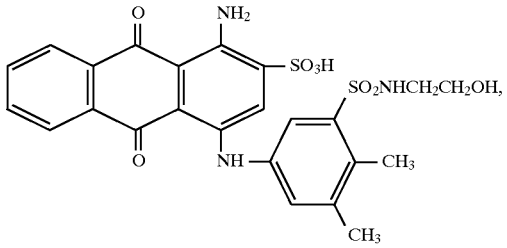

the K value of the dye mixture being 4, 15 parts of a commercially available guar thickening, and 10 parts of an 18% aqueous solution of the compound of formula

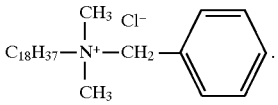

(100)

The pH is adjusted to 4 with acetic acid.

A padding liquor of the following composition is then poured over the goods at a 300% liquor pick-up. This liquor comprises per 1000 parts:

0.7 part of the orange-dyeing dye mixture, comprising 18% by weight of the dye which, in the form of the free acid, corresponds to formula

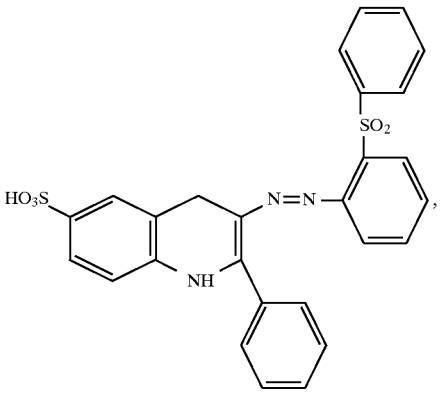

68% by weight of the dye which, in the form of the free acid, corresponds to formula

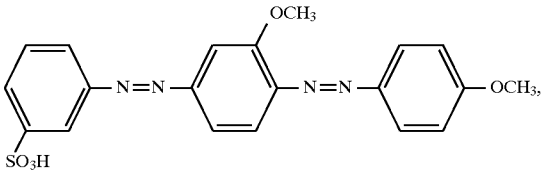

10% by weight of the dye which, in the form of the free acid, corresponds to formula

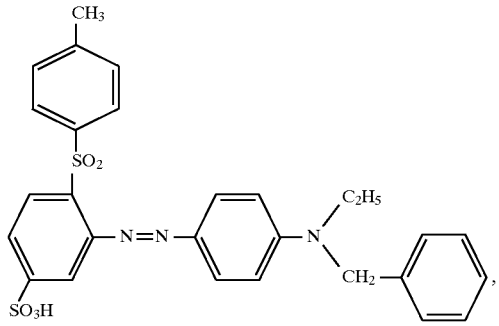

and 4% by weight of the dye which, in the form of the free acid, corresponds to formula

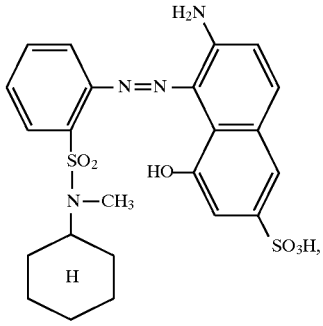

the K value of the dye mixture being 4, 0.4 part of the red-dyeing dye which, in the form of the free acid, corresponds to formula

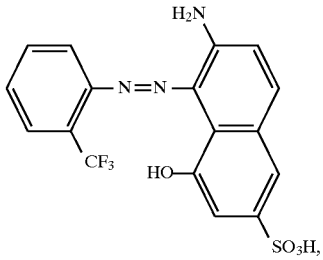

having a K value of 4, 1.1 parts of the above blue-dyeing dye mixture, 2.0 parts of ammonium acetate, 2.0 parts of a commercially available wetting agent, 0.7 part of a commercially available antifrosting assistant, and 8.0 parts of a commercially available guar thickening.

The pH is adjusted to 6 with acetic acid.

Subsequently, the carpet is treated for 10 min. with saturated steam at 100° C. and is then rinsed.

Where it is printed, the carpet has blue spots having sharp outlines and good brilliance on a black ground.

EXAMPLE 2

A polyamide 66 carpet is padded with a liquor (100% liquor pick-up) comprising the following components per 1000 parts:

1.6 parts of the orange-dyeing dye mixture of Example 1, 1.2 parts of the red-dyeing dye of Example 1, 3.3 parts of the blue-dyeing dye mixture of Example 1, 2.0 parts of ammonium acetate, 2.0 parts of a commercially available wetting agent, 2.0 parts of a commercially available antifrosting assistant, and 2.0 parts of a commercially available guar thickening.

The pH is adjusted to 6 with acetic acid.

The carpet goods pretreated in this manner are printed successively with pastes of the following composition:

Printing paste 1 (per 1000 parts):

1 part of the orange-dyeing dye mixture of Example 1, 10 parts of an 18% aqueous solution of the compound of formula (100) according to Example 1, and 8 parts of a commercially available guar thickening.

The pH is adjusted to 4 with acetic acid.

Printing paste 2 (per 1000 parts):

0.09 part of the orange-dyeing dye mixture of Example 1, 0.05 part of the red-dyeing dye of Example 1,

0.27part of the blue-dyeing dye mixture of Example 1, 10.0 parts of a n 18% aqueous solution of the compound of formula (100) according to Example 1, and 8 parts of a commercially available guar thickening.

The pH is adjusted to 4 with acetic acid.

Printing paste 3 (per 1000 parts): (without dyes)

8 parts of a commercially available guar thickening, and 10 parts of an 18% aqueous solution of the compound of formula (100) according to Example 1.

The pH is adjusted to 4 with acetic acid.

Subsequently, the carpet goods are steamed for 10 minutes at 100° C. and are then rinsed.

The carpet has white, yellow and blue printed spots having sharp outlines on a dark grey ground.

EXAMPLE 3

Knitted goods consisting of polyamide 66 carpet yarn are padded with a liquor at a 100% pick-up. This liquor comprises per 1000 parts:

0.72 part of the orange-dyeing dye mixture of Example 1, 0.50 part of the red-dyeing dye of Example 1

0.60 part of the blue-dyeing dye mixture of Example 1, 2.00 parts of a commercially available wetting agent, 2.00 parts of a commercially available antifrostng assistant, 1.00 part of a commercially available guar thickening, and 3.00 parts of ammonium acetate.

The pH is adjusted to 6 with acetic acid.

Printing is then carried out with 2 different printing pastes.

Printing paste 1 (per 1000 parts):

0.50 part of the orange-dyeing dye mixture of Example 1, 0.50 part of the blue-dyeing dye mixture of Example 1, 10.00 parts of an 18% aqueous solution of the compound of formula (100) according to Example 1, and 8.00 parts of a commercially available guar thickening.

The pH is adjusted to 4 with acetic acid.

Printing paste 2 (per 1000 parts): (without dyes)

10.00 parts an 18% aqueous solution of the compound of formula (100) according to Example 1, and 8.00 parts of a commercially available guar thickening.

The pH is adjusted to 4 with acetic acid.

Subsequently, the goods are steamed for 10 minutes with saturated steam at 100° C. and are then rinsed.

The printed pattern consists of pure green and white spots printed on a dark brown ground.

EXAMPLE 4

A looped carpet consisting of polyamide 66 carpet yarn is partially printed using an jet printing machine (Chromojet or Millitron). The dye paste comprises the following components per 1000 parts:

0.5 part of the blue-dyeing dye mixture comprising 80% by weight of the dye which, in the form of the free acid, corresponds to

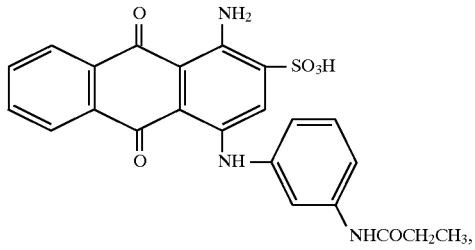

and 20% by weight of the dye which, in the form of the free acid, corresponds to formula

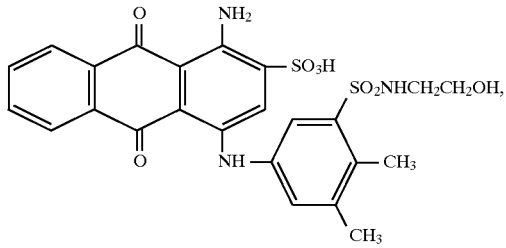

the K value of the dye mixture being 4, 22 parts of a thickener suitable for jet printing, and 10 parts of an 18% aqueous solution of the compound of formula

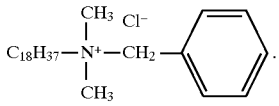

(100)

The pH is adjusted to 4 with acetic acid.

A padding liquor of the following composition is then poured over these goods at a 300% liquor pick-up. This liquor comprises per 1000 parts:

0.7 part of the red-dyeing dye which, in the form of the free acid, corresponds to formula

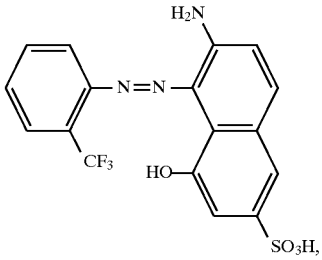

and which has a K value of 4, 2.0 parts of ammonium acetate, 2.0 parts of a commercially available wetting agent, 0.7 part of a commercially available antifrosting assistant, and 2.0 parts of a commercially available guar thickening.

The pH is adjusted to 6 with acetic acid.

Subsequently, the carpet is treated for 10 min. with saturated steam at 100° C. and is then rinsed.

Where it is printed, the carpets has blue spots having sharp outlines and good brilliance on a red ground.

EXAMPLE 5

A looped carpet consisting of polyamide 6 carpet yarn is partially printed using printing screens and a printing paste analogous to the printing paste of Example 1. The carpet is then printed all over using a blotch printing screen. The printing paste comprises the following components per 1000 parts: 0.7 part of the red-dyeing dye which, in the form of the free acid, corresponds to formula

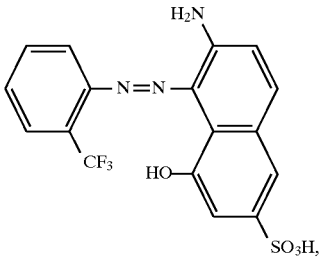

and which has a K value of 4, 2.0 parts of a commercially available wetting agent, 0.7 part of a commerically available antifrosting assistant, and 10 parts of a commercially available guar thickening.

The pH is adjusted to 6 with acetic acid.

Subsequently, the carpet is treated for 10 min. with saturated steam at 100° C. and is then rinsed.

Where it is printed, the carpet has blue spots having sharp outlines and good brilliance on a red ground.

EXAMPLE 6

Examples 1 to 5 are repeated, but replacing the compound of formula (100) with an equivalent amount of the compounds of the following formulae or the cited mixture, giving equally good results:

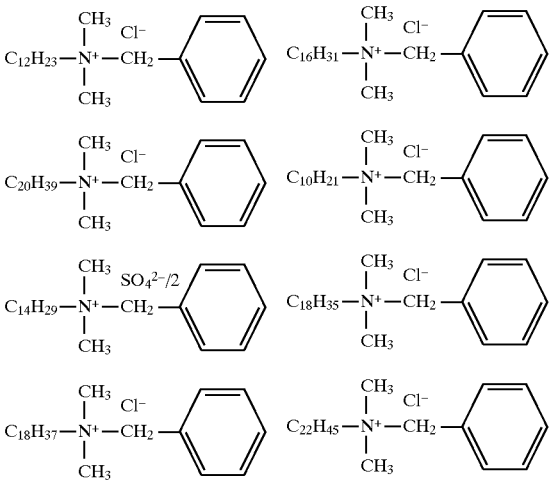

-continued

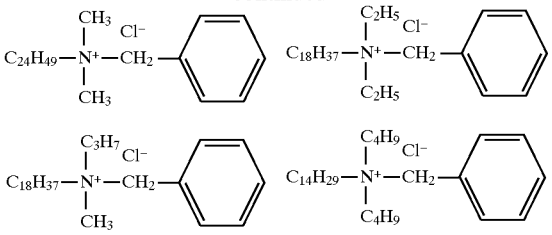

and the mixture

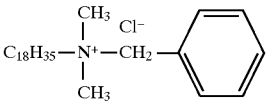

and

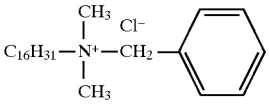

in a ratio of 2:1.

What is claimed is:

1. A process for the production of resists or multicolour effects on natural or synthetic polyamide fibre materials, which, to produce resists, comprises locally applying a liquid preparation wet-on-wet before or after treating the textile material with a dyeing liquor or printing paste containing at least one anionic dye, said preparation comprising one or more than one compound of formula

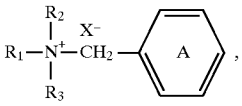

(1)

wherein $R_1$ is a straight-chain or branched $C_{10}$–$C_{24}$alkyl or alkenyl radical, $R_2$ and $R_3$ are each independently of the other $C_1$–$C_4$alkyl, X is the radical of an anion, and the benzene nucleus A is unsubstituted or substituted by $C_1$–$C_4$alkyl, $C_1$–$C_4$alkoxy or halogen, or which, to produce multicolour effects, comprises locally applying one or more than one liquid preparation wet-on-wet before or after treating the textile material with a dyeing liquor or printing paste containing at least one anionic dye, said preparation comprising, in addition to one or more than one compound of formula (1), at least one anionic dye, and lastly subjecting the textile goods to a heat treatment to fix the dye.

2. A process according to claim 1, which, to produce resists or multicolour effects, comprises locally applying one or more than one liquid preparation after treating the textile material with a dyeing liquor or printing paste containing at least one anionic dye, and then subjecting the textile goods to a heat treatment to fix the dye.

3. A process according to claim 1, which, to produce resists or multicolour effects, comprises locally applying one or more than one liquid preparation before treating the textile material with a dyeing liquor or printing paste containing at least one anionic dye, and then subjecting the textile material to a heat treatment to fix the dye.

4. A process according to claim 1, which comprises using one or more than one compound of formula (1), wherein $R_1$ is a decyl, undecyl, dodecyl, tridecyl, tetradecyl, hexadecyl, heptadecyl, octadecyl or oleyl radical.

5. A process according to claim 1, which comprises using one or more than one compound of formula (1), wherein $R_2$ and $R_3$ are methyl.

6. A process according to claim 1, which comprises using one or more than one compound of formula (1), wherein $R_1$ is a straight-chain $C_{14}$–$C_{18}$alkyl radical.

7. A process according to claim 1, which comprises using one or more than one compound of formula (1), wherein the benzene nucleus A does not contain any further substituent.

8. A process according to claim 1, which comprises using one or more than one compound of formula (1), wherein $X^-$ is a sulfate ion or a chloride ion.

9. A process according to claim 1, which comprises using anionic dyes having a K value <5 in the dye liquor used for treating the textile material.

10. A process according to claim 1, which comprises using anionic dyes having a K value <5 for the production of multicolour effects.

11. A process according to claim 1, which comprises using anionic dyes having a K value of <5 in all dye liquors or printing pastes used for the production of multicolour effects.

12. A process according to claim 1 for the production of resists or multicolour effects on carpet materials, preferably on polyamide 6 or polyamide 66 material.

* * * * *